US008254585B2

(12) United States Patent
Schuijers et al.

(10) Patent No.: US 8,254,585 B2
(45) Date of Patent: Aug. 28, 2012

(54) STEREO CODING AND DECODING METHOD AND APPARATUS THEREOF

(75) Inventors: Erik Gosuinus Petrus Schuijers, Oss (NL); Dirk Jeroen Breebaart, Eindhoven (NL); Francois Philippus Myburg, Almere (NL); Leon Maria Van De Kerkhof, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 367 days.

(21) Appl. No.: 12/623,676

(22) Filed: Nov. 23, 2009

(65) Prior Publication Data

US 2011/0106540 A1 May 5, 2011

Related U.S. Application Data

(62) Division of application No. 10/599,564, filed as application No. PCT/IB2005/051058 on Mar. 29, 2005, now Pat. No. 7,646,875.

(30) Foreign Application Priority Data

Apr. 5, 2004 (EP) ..... 04101405
Jul. 5, 2004 (EP) ..... 04103168

(51) Int. Cl.
*H04R 5/00* (2006.01)

(52) U.S. Cl. ..... 381/23; 381/22; 381/97

(58) Field of Classification Search ..... 381/1, 17–23, 381/119, 97, 102; 704/500, 501, 200.1
See application file for complete search history.

(56) References Cited

U.S. PATENT DOCUMENTS

| | | | | |
|---|---|---|---|---|
| 5,621,855 | A | 4/1997 | Veldhuis et al. | |
| 5,636,324 | A | 6/1997 | Teh et al. | |
| 5,682,461 | A | 10/1997 | Silzle et al. | |
| 5,727,119 | A | 3/1998 | Davidson et al. | |
| 7,181,019 | B2 | 2/2007 | Breebaart et al. | |
| 7,272,556 | B1 | 9/2007 | Aguilar et al. | |
| 7,394,903 | B2 * | 7/2008 | Herre et al. | 381/23 |
| 7,437,299 | B2 | 10/2008 | Aarts et al. | |
| 7,573,912 | B2 * | 8/2009 | Lindblom | 370/487 |
| 7,646,875 | B2 * | 1/2010 | Schuijers et al. | 381/23 |
| 8,010,373 | B2 * | 8/2011 | Myburg et al. | 704/500 |

OTHER PUBLICATIONS

ISO/IEC JTCI/SC29/WG11 MPEG, IS 11172-3, Information Technology-Coding of Moving Pictures and Associated Audio for Digital Storage Media At Up to About 1.5 Mbit/S, Part 3: Audio, MPEG-1, 1992.

Johnston et al; "Sum-Difference Stereo Transform Coding"; in Proc,. IEEE, Int. Conference Acoust., Speech and Signal Proc., SNA Francisco, CA, Mar. 1992, pp. II-569-II-572.

* cited by examiner

*Primary Examiner* — Xu Mei

(57) ABSTRACT

A method of encoding input signals (l, r) to generate encoded data (100) is provided. The method involves processing the input signals (l, r) to determine first parameters ($\phi_1$, $\phi_2$) describing relative phase difference and temporal difference between the signals (l, r), and applying these first parameters ($\phi_1$, $\phi_2$) to process the input signals to generate intermediate signals. The method involves processing the intermediate signals to determine second parameters ($\alpha$; IID, $\rho$) describing angular rotation of the first intermediate signals to generate a dominant signal (m) and a residual signal (s), the dominant signal (m) having a magnitude or energy greater than that of the residual signal (s). These second parameters are applicable to process the intermediate signals to generate the dominant (m) and residual (s) signals. The method also involves quantizing the first parameters, the second parameters, and dominant and residual signals (m, s) to generate corresponding quantized data for subsequent multiplexing to generate the encoded data (100).

9 Claims, 9 Drawing Sheets

STEREO CODING AND DECODING METHOD AND APPARATUS THEREOF

This application is a divisional application of U.S. Ser. No. 10/599,564, filed Oct. 2, 2006, now U.S. Pat. No. 7,646,875 which is a 35 U.S.C. 371 application of PCT/IB05/51058, filed Mar. 29, 2005.

The present invention relates to methods of coding data, for example to a method of coding audio and/or image data utilizing variable angle rotation of data components. Moreover, the invention also relates to encoders employing such methods, and to decoders operable to decode data generated by these encoders. Furthermore, the invention is concerned with encoded data communicated via data carriers and/or communication networks, the encoded data being generated according to the methods.

Numerous contemporary methods are known for encoding audio and/or image data to generate corresponding encoded output data. An example of a contemporary method of encoding audio is MPEG-1 Layer III known as MP3 and described in ISO/IEC JTC1/SC29/WG11 MPEG, IS 11172-3, Information Technology—Coding of Moving Pictures and Associated Audio for Digital Storage Media at up to about 1.5 Mbit/s, Part 3: Audio, MPEG-1, 1992. Some of these contemporary methods are arranged to improve coding efficiency, namely provide enhanced data compression, by employing mid/side (M/S) stereo coding or sum/difference stereo coding as described by J. D. Johnston and A. J. Ferreira, "Sum-difference stereo transform coding", in Proc. IEEE, Int. Conf. Acoust., Speech and Signal Proc., San Francisco, Calif., March 1992, pp. II: pp. 569-572.

In M/S coding, a stereo signal comprises left and right signals l[n], r[n] respectively which are coded as a sum signal m[n] and a difference signal s[n], for example by applying processing as described by Equations 1 and 2 (Eq. 1 and 2):

$$m[n]=r[n]+l[n] \quad \text{Eq. 1}$$

$$s[n]=r[n]-l[n] \quad \text{Eq. 2}$$

When the signals l[n] and r[n] are almost identical, the M/S coding is capable of providing significant data compression on account of the difference signal s[n] approaching zero and thereby conveying relatively little information whereas the sum signal effectively includes most of the signal information content. In such a situation, a bit rate required to represent the sum and difference signals is close to half that required for independently coding the signals l[n] and r[n].

Equations 1 and 2 are susceptible to being represented by way of a rotation matrix as in Equation 3 (Eq. 3):

$$\begin{pmatrix} m[n] \\ s[n] \end{pmatrix} = c\begin{pmatrix} \cos(\frac{\pi}{4}) & \sin(\frac{\pi}{4}) \\ -\sin(\frac{\pi}{4}) & \cos(\frac{\pi}{4}) \end{pmatrix}\begin{pmatrix} l[n] \\ r[n] \end{pmatrix} \quad \text{Eq. 3}$$

wherein c is a constant scaling coefficient often used to prevent clipping.

Whereas Equation 3 effectively corresponds to a rotation of the signals l[n], r[n] by an angle of 45°, other rotation angles are possible as provided in Equation 4 (Eq. 4) wherein α is a rotation angle applied to the signals l[n], r[n] to generate corresponding coded signals m'[n], s'[n] hereinafter described as relating to dominant and residual signals respectively:

$$\begin{pmatrix} m'[n] \\ s'[n] \end{pmatrix} = c\begin{pmatrix} \cos(\alpha) & \sin(\alpha) \\ -\sin(\alpha) & \cos(\alpha) \end{pmatrix}\begin{pmatrix} l[n] \\ r[n] \end{pmatrix} \quad \text{Eq. 4}$$

The angle α is beneficially made variable to provide enhanced compression for a wide class of signals l[n], r[n] by reducing information content present in the residual signal s'[n] and concentrating information content in the dominant signal m'[n], namely minimize power in the residual signal s'[n] and consequently maximize power in the dominant signal m'[n].

Coding techniques represented by Equations 1 to 4 are conventionally not applied to broadband signals but to sub-signals each representing only a smaller part of a full bandwidth used to convey audio signals. Moreover, the techniques of Equations 1 to 4 are also conventionally applied to frequency domain representations of the signals l[n], r[n].

In a published U.S. Pat. No. 5,621,855, there is described a method of sub-band coding a digital signal having first and second signal components, the digital signal being sub-band coded to produce a first sub-band signal having a first q-sample signal block in response to the first signal component, and a second sub-band signal having a second q-sample signal block in response to the second signal component, the first and second sub-band signals being in the same sub-band and the first and second signal blocks being time equivalent.

The first and second signal blocks are processed to obtain a minimum distance value between point representations of time-equivalent samples. When the minimum distance value is less than or equal to a threshold distance value, a composite block composed of q samples is obtained by adding the respective pairs of time-equivalent samples in the first and second signal blocks together after multiplying each of the samples of the first block by cos(α) and each of the samples of the second signal block by −sin(α).

Although application of the aforementioned rotation angle α is susceptible to eliminating many disadvantages of M/S coding where only a 45° rotation is employed, such approaches are found to be problematic when applied to groups of signals, for example stereo signal pairs, when considerable relative mutual phase or time offsets in these signals occur. The present invention is directed at addressing this problem.

An object of the present invention is to provide a method of encoding data.

According to a first aspect of the present invention, there is provided a method of encoding a plurality of input signals (l, r) to generate corresponding encoded data, the method comprising steps of:

(a) processing the input signals (l, r) to determine first parameters ($\phi_2$) describing at least one of relative phase difference and temporal difference between the signals (l, r), and applying these first parameters ($\phi_2$) to process the input signals to generate corresponding intermediate signals;

(b) processing the intermediate signals and/or the input signals (l, r) to determine second parameters describing rotation of the intermediate signals required to generate a dominant signal (m) and a residual signal (s), said dominant signal (m) having a magnitude or energy greater than that of the residual signal (s), and applying these second parameters to process the intermediate signals to generate the dominant (m) and residual (s) signals;

(c) quantizing the first parameters, the second parameters, and encoding at least a part of the dominant signal (m) and the residual signal (s) to generate corresponding quantized data; and (d) multiplexing the quantized data to generate the encoded data.

The invention is of advantage in that it is capable of providing for more efficient encoding of data.

Preferably, in the method, only a part of the residual signal (s) is included in the encoded data. Such partial inclusion of the residual signal (s) is capable of enhancing data compression achievable in the encoded data.

More preferably, in the method, the encoded data also includes one or more parameters indicative of parts of the residual signal included in the encoded data. Such indicative parameters are susceptible to rendering subsequent decoding of the encoded data less complex.

Preferably, steps (a) and (b) of the method are implemented by complex rotation with the input signals (l[n], r[n]) represented in the frequency domain (l[k], r[k]). Implementation of complex rotation is capable of more efficiently coping with relative temporal and/or phase differences arising between the plurality of input signals. More preferably, steps (a) and (b) are performed in the frequency domain or a sub-band domain. "Sub-band" is to be construed to be a frequency region smaller than a full frequency bandwidth required for a signal.

Preferably, the method is applied in a sub-part of a full frequency range encompassing the input signals (l, r). More preferably, other sub-parts of the full frequency range are encoded using alternative encoding techniques, for example conventional M/S encoding as described in the foregoing.

Preferably, the method includes an additional step after step (c) of losslessly coding the quantized data to provide the data for multiplexing in step (d) to generate the encoded data. More preferably, the lossless coding is implemented using Huffman coding. Utilizing lossless coding enables potentially higher audio quality to be achieved.

Preferably, the method includes a step of manipulating the residual signal (s) by discarding perceptually non-relevant time-frequency information present in the residual signal (s), said manipulated residual signal (s) contributing to the encoded data (100), and said perceptually non-relevant information corresponding to selected portions of a spectro-temporal representation of the input signals. Discarding perceptually non-relevant information enables the method to provide a greater degree of data compression in the encoded data.

Preferably, in step (b) of the method, the second parameters ($\alpha$; IID, $\rho$) are derived by minimizing the magnitude or energy of the residual signal (s). Such an approach is computationally efficient for generating the second parameters in comparison to alternative approaches to deriving the parameters.

Preferably, in the method, the second parameters ($\alpha$; IID, $\rho$) are represented by way of inter-channel intensity difference parameters and coherence parameters (IID, $\rho$). Such implementation of the method is capable of providing backward compatibility with existing parametric stereo encoding and associated decoding hardware or software.

Preferably, in steps (c) and (d) of the method, the encoded data is arranged in layers of significance, said layers including a base layer conveying the dominant signal (m), a first enhancement layer including first and/or second parameters corresponding to stereo imparting parameters, a second enhancement layer conveying a representation of the residual signal (s). More preferably, the second enhancement layer is further subdivided into a first sub-layer for conveying most relevant time-frequency information of the residual signal (s) and a second sub-layer for conveying less relevant time-frequency information of the residual signal (s). Representation of the input signals by these layers, and sub-layers as required is capable of enhancing robustness to transmission errors of the encoded data and rendering it backward compatible with simpler decoding hardware.

According to a second aspect of the invention, there is provided an encoder for encoding a plurality of input signals (l, r) to generate corresponding encoded data, the encoder comprising:

(a) first processing means for processing the input signals (l, r) to determine first parameters ($\phi_2$) describing at least one of relative phase difference and temporal difference between the signals (l, r), the first processing means being operable to apply these first parameters ($\phi_2$) to process the input signals to generate corresponding intermediate signals;

(b) second processing means for processing the intermediate signals to determine second parameters describing rotation of the intermediate signals required to generate a dominant signal (m) and a residual signal (s), said dominant signal (m) having a magnitude or energy greater than that of the residual signal (s), the second processing means being operable to apply these second parameters to process the intermediate signals to generate at least the dominant (m) and residual (s) signals;

(c) quantizing means for quantizing the first parameters ($\phi_2$), the second parameters ($\alpha$; IID, $\rho$), and at least a part of the dominant signal (m) and the residual signal (s) to generate corresponding quantized data; and (d) multiplexing means for multiplexing the quantized data to generate the encoded data.

The encoder is of advantage in that it is capable of providing for more efficient encoding of data.

Preferably, the encoder comprises processing means for manipulating the residual signal (s) by discarding perceptually non-relevant time-frequency information present in the residual signal (s), said transformed residual signal (s) contributing to the encoded data (100) and said perceptually non-relevant information corresponding to selected portions of a spectro-temporal representation of the input signals. Discarding perceptually non-relevant information enables the encoder to provide a greater degree of data compression in the encoded data.

According to a third aspect of the present invention, there is provided a method of decoding encoded data to regenerate corresponding representations of a plurality of input signals (l', r'), said input signals (l, r) being previously encoded to generate said encoded data, the method comprising steps of:

(a) de-multiplexing the encoded data to generate corresponding quantized data;

(b) processing the quantized data to generate corresponding first parameters ($\phi_2$), second parameters, and at least a dominant signal (m) and a residual signal (s), said dominant signal (m) having a magnitude or energy greater than that of the residual signal (s);

(c) rotating the dominant (m) and residual (s) signals by applying the second parameters to generate corresponding intermediate signals; and (d) processing the intermediate signals by applying the first parameters ($\phi_2$) to regenerate said representations of said input signals (l', r'), the first parameters ($\phi_2$) describing at least one of relative phase difference and temporal difference between the signals (l, r).

The method provides an advantage of being capable of efficiently decoding data which has been efficiently coding using a method according to the first aspect of the invention.

Preferably, step (b) of the method includes a further step of appropriately supplementing missing time-frequency information of the residual signal (s) with a synthetic residual signal derived from the dominant signal (m). Generation of the synthetic signal is capable of resulting in efficient decoding of encoded data.

Preferably, in the method, the encoded data includes parameters indicative of which parts of the residual signal (s) are encoded into the encoded data. Inclusion of such indicative parameters is capable of rendering decoding for efficient and less computationally demanding.

According to a fourth aspect of the present invention, there is provided a decoder for decoding encoded data to regenerate corresponding representations of a plurality of input signals (l', r'), said input signals (l, r) being previously encoded to generate the encoded data, the decoder comprising:

(a) de-multiplexing means for de-multiplexing the encoded data to generate corresponding quantized data;

(b) first processing means for processing the quantized data to generate corresponding first parameters ($\phi_2$), second parameters, and at least a dominant signal (m) and a residual signal (s), said dominant signal (m) having a magnitude or energy greater than that of the residual signal (s);

(c) second processing means for rotating the dominant (m) and residual (s) signals by applying the second parameters to generate corresponding intermediate signals; and (d) third processing means for processing the intermediate signals by applying the first parameters ($\phi_2$) to regenerate said representations of the input signals (l, r), the first parameters ($\phi_2$) describing at least one of relative phase difference and temporal difference between the signals (l, r).

Preferably, the second processing means is operable to generate a supplementary synthetic signal derived from the decoded dominant signal (m) for providing information missing from the decoded residual signal.

According to a fifth aspect of the invention, there is provided encoded data generated according to the method of the first aspect of the invention, the data being recorded on a data carrier in the form of a non-transitory computer-readable storage medium.

According to a sixth aspect of the invention, there is provided software for executing the method of the first aspect of the invention on computing hardware.

According to a seventh aspect of the invention, there is provided software for executing the method of the third aspect of the invention on computing hardware.

According to an eighth aspect of the invention, there is provided encoded data recorded on a data carrier in the form of a non-transitory computer-readable storage medium, said encoded data comprising a multiplex of quantizing first parameters, quantized second parameters, and. quantized data corresponding to at least a part of a dominant signal (m) and a residual signal (s), wherein the dominant signal (m) has a magnitude or energy greater than the residual signal (s), said dominant signal (m) and said residual signal (s) being derivable by rotating intermediate signals according to the second parameters, said intermediate signals being generated by processing a plurality of input signals to compensate for relative phase and/or temporal delays therebetween as described by the first parameters.

It will be appreciated that features of the invention are susceptible to being combined in any combination without departing from the scope of the invention as defined in the accompanying claims.

Embodiments of the invention will now be described, by way of example only, with reference to the following diagrams wherein.

Figure 1:
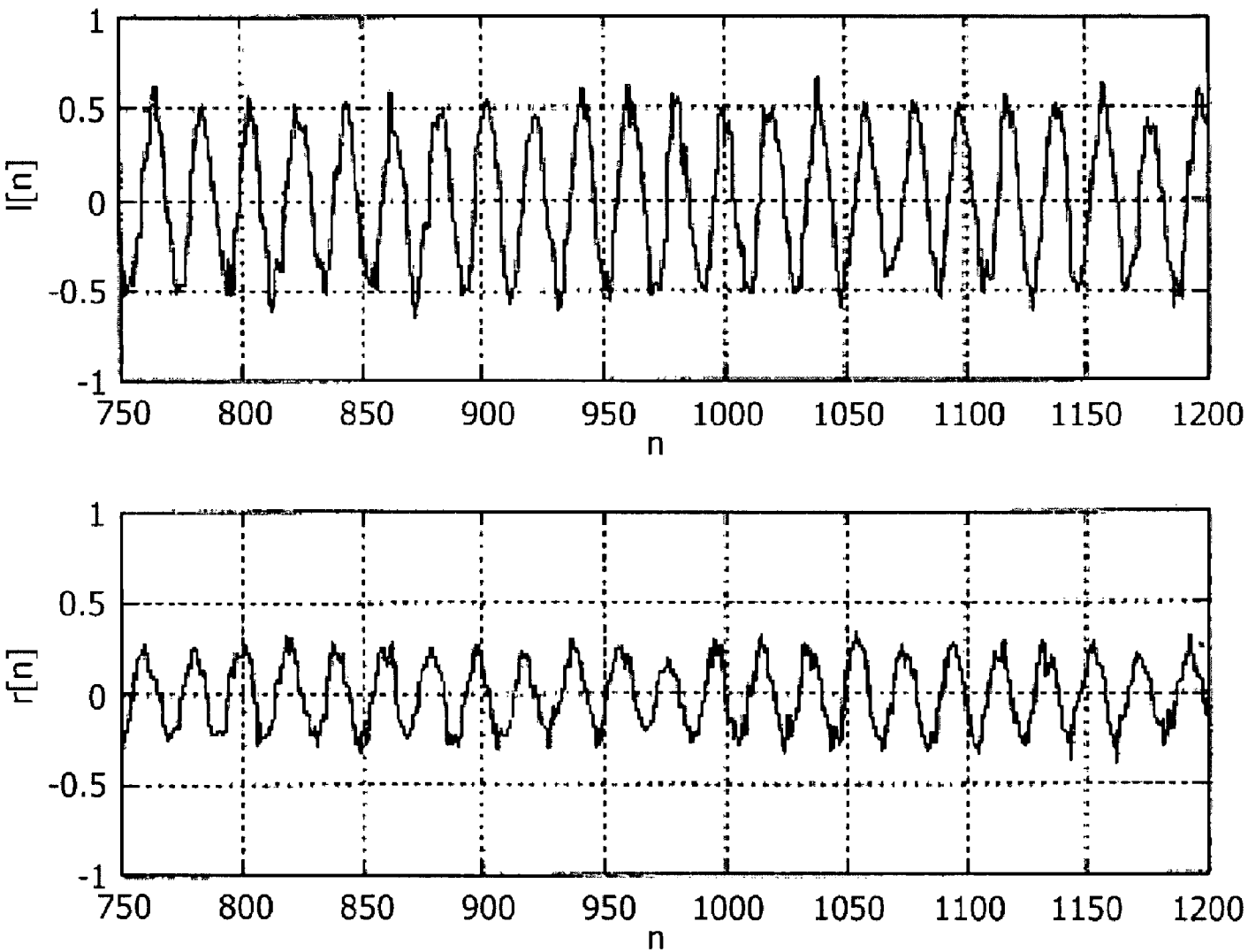
FIG. 1 is an illustration of sample sequences for signals l[n], r[n] subject to relative mutual time and phase delays.

In overview, the present invention is concerned with a method of coding data which represents an advance to M/S coding methods described in the foregoing employing a variable rotation angle. The method is devised by the inventors to be better capable of coding data corresponding to groups of signals subject to considerable phase and/or time offset. Moreover, the method provides advantages in comparison to conventional coding techniques by employing values for the rotation angle $\alpha$ which can be used when the signals l[n], r[n] are represented by their equivalent complex-valued frequency domain representations l[k], r[k] respectively.

The angle $\alpha$ can be arranged to be real-valued and a real-valued phase rotation applied to mutually "cohere" the l[n], r[n] signals to accommodate mutual temporal and/or phase delays between these signals. However, use of complex values for the rotation angle $\alpha$ renders the present invention easier to implement. Such an alternative approach to implementing rotation by angle $\alpha$ is to be construed to be within the scope of the present invention.

Frequency-domain representations of the aforesaid time-domain signals l[n], r[n] are preferably derived by applying a temporal windowing procedure as described by Equations 5 and 6 (Eq. 5 and 6) to provide windowed signals $l_q[n]$, $r_q[n]$:

$$l_q[n]=l[n+qH]\cdot h[n] \quad \text{Eq. 5}$$

$$r_q[n]=r[n+qH]\cdot h[n] \quad \text{Eq. 6}$$

wherein q=a frame index such that q=0, 1, 2, . . . to indicate consecutive signal frames;

H=a hop-size or update-size; and n=a time index having a value in a range of 0 to L−1 wherein a parameter L is equivalent to the length of a window h[n].

The windowed signals $l_q[n]$, $r_q[n]$ are transformable to the frequency domain by using a Discrete Fourier Transform (DFT), or functionally equivalent transform, as described in Equations 7 and 8 (Eq. 7 and 8):

$$l[k] = \sum_{n=0}^{N-1} l_q[n].\exp\left(-j\frac{2\pi kn}{N}\right) \quad \text{Eq. 7}$$

$$r[k] = \sum_{n=0}^{N-1} r_q[n].\exp\left(-j\frac{2\pi kn}{N}\right) \quad \text{Eq. 8}$$

wherein a parameter N represents a DFT length such that N≧L. On account of the DFT of a real-valued sequence being symmetrical, only the first N/2+1 points are preserved after the transform. In order to preserve signal energy when implementing the DFT, the following scaling as described in Equations 9 and 10 (Eq. 9 and 10) is preferably employed:

$$l[0] = \frac{l[0]}{2} \quad \text{Eq. 9}$$

$$r[0] = \frac{r[0]}{2} \quad \text{Eq. 10}$$

The method of the invention performs signal processing operations as depicted by Equation 11 (Eq. 11) to convert the frequency domain signal representations l[k], r[k] in Equations 7 and 8 to corresponding rotated sum and difference signals m"[k], s"[k] in the frequency domain:

$$\begin{pmatrix} m''[k] \\ s''[k] \end{pmatrix} = \begin{pmatrix} \cos(\alpha) & \sin(\alpha) \\ -\sin(\alpha) & \cos(\alpha) \end{pmatrix} \begin{pmatrix} e^{j\varphi_1} & 0 \\ 0 & e^{j(\varphi_1-\varphi_2)} \end{pmatrix} \begin{pmatrix} l[k] \\ r[k] \end{pmatrix} \quad \text{Eq. 11}$$

wherein $\alpha$=real-valued variable rotation angle;

$\phi_1$=a common angle used to maximise the continuation of signals over associated boundaries; and $\phi_2$=an angle used to minimize the energy of the residual signal s"[k] by phase-rotating the right signal r[k].

Use of the angle $\phi_1$ is optional. Moreover, rotations pursuant to Equation 11 are preferably executed on a frame-by-frame basis, namely dynamically in frame steps. However, such dynamic changes in rotation from frame-to-frame can potentially cause signal discontinuities in the sum signal m"[k] which can be at least partially removed by suitable selection of the angle $\phi_1$.

Furthermore, the frequency range k=0 . . . N/2+1 of Equation 11 is preferably divided into sub-ranges, namely regions. For each region during encoding, its corresponding angle parameters $\alpha$, $\phi_1$ and $\phi_2$ are then independently determined, coded and then transmitted or otherwise conveyed to a decoder for subsequent decoding. By arranging for the frequency range to be sub-divided, signal properties can be better captured during encoding resulting potentially in higher compression ratios.

After implementing mappings pursuant to Equations 7 to 11, the signals m"[k], s"[k] are subjected to an inverse Discrete Fourier Transform as described in Equations 12 and 13 (Eq. 12 & 13):

$$m_q[n] = \sum_{n=0}^{N-1} m[k].\exp\left(j\frac{2\pi kn}{N}\right) \quad \text{Eq. 12}$$

-continued $$s_q[n] = \sum_{n=0}^{N-1} s[k].\exp\left(j\frac{2\pi kn}{N}\right) \quad \text{Eq. 13}$$

wherein $m_q[n]$=dominant time-domain representation; and $s_q[n]$=residual (difference) time-domain representation.

The dominant and residual representations are then converted in the method to representations on a windowed basis to which overlap is applied as provided by processing operations as described by Equations 14 and 15 (Eq. 14 and 15):

$$m[n+qH]=m[n+qH]+2Re\{m_q[n]\cdot h[n]\} \quad \text{Eq. 14}$$

$$s[n+qH]=s[n+qH]+2Re\{s_q[n]\cdot h[n]\} \quad \text{Eq. 15}$$

Alternatively, processing operations of the method of the invention as described by Equations 5 to 15 are susceptible, at least in part, to being implemented in practice by employing complex-modulated filter banks. Digital processing applied in computer processing hardware can be employed to implement the invention.

In order to illustrate the method of the invention, a signal processing example of the invention will now be described. For the example, two temporal signals are used as initial signals to be processed using the method, the two signals being defined by Equations 16 and 17 (Eq. 16 and 17):

$$l[n]=0.5\cos(0.32n+0.4)+0.05\cdot z_1[n]+0.06\cdot z_2[n] \quad \text{Eq. 16}$$

$$r[n]=0.25\cos(0.32n+1.8)+0.03\cdot z_1[n]+0.05\cdot z_3[n] \quad \text{Eq. 17}$$

wherein $z_1$ [n], $z_2$[n] and $z_3$[n] are mutually independent white noise sequences of unity variance. In order to better appreciate operation of the method of the invention, portions of the signals l[n], r[n] described by Equations 16 and 17 are shown in FIG. 1.

Figure 2:
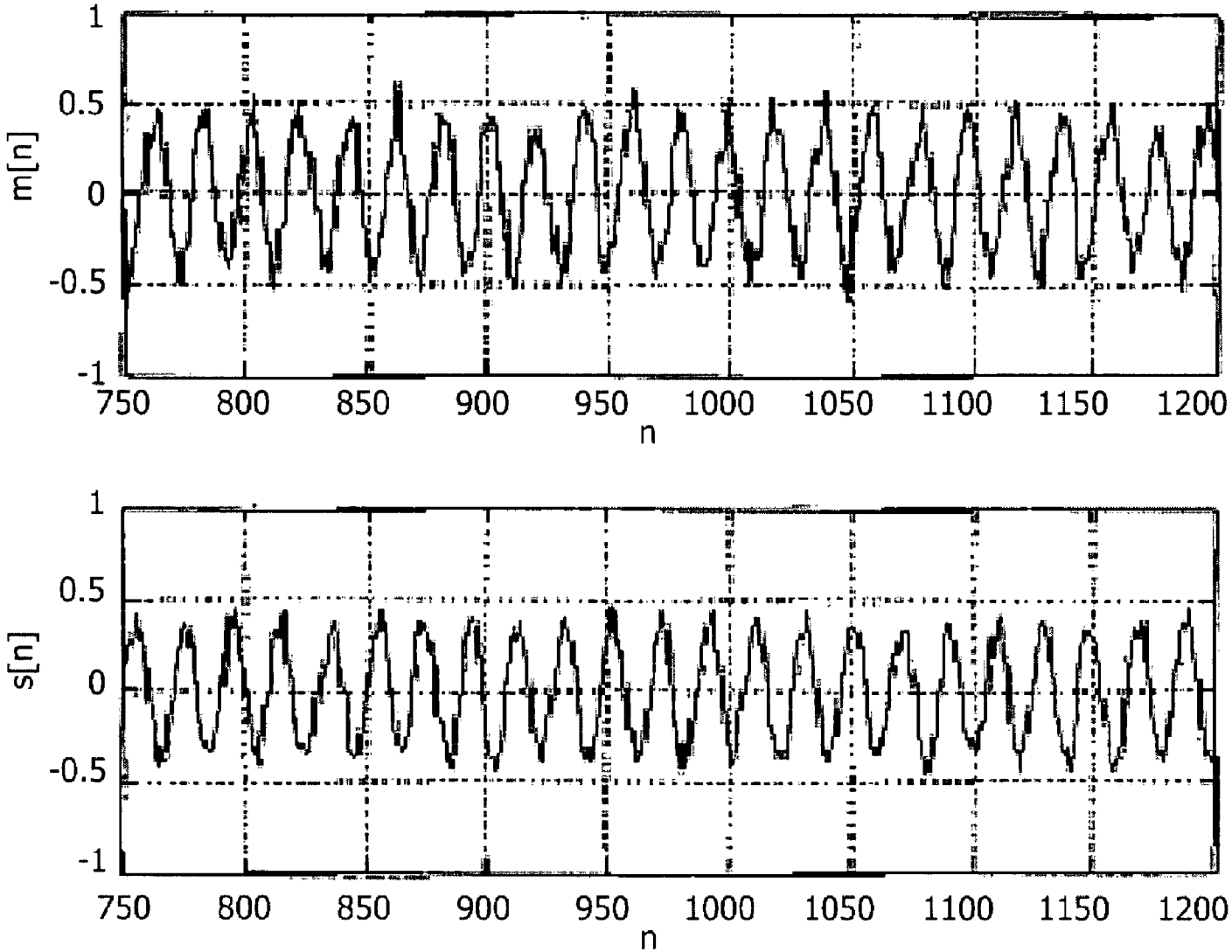
FIG. 2 is an illustration of application of a conventional M/S transform pursuant to Equations 1 and 2 applied to the signals of FIG. 1 to generate corresponding sum and difference signals m[n], s[n]

In FIG. 2, M/S transform signals m[n] and s[n] are illustrated, these transform signals being derived from the signals l[n],r[n] of Equations 16 and 17 by conventional processing pursuant to Equations 1 and 2. It will be seen from FIG. 2 that such a conventional approach to generating the signals m[n] and s[n] from the signals of Equations 16 and 17 results in the energy of the residual signal s[n] being higher than the energy of the input signal r[n] in Equation 17. Clearly, conventional M/S transform signal processing applied to the signals of Equations 16 and 17 is ineffective at resulting in signal compression because the signal s[n] is not of negligible magnitude.

Figure 3:
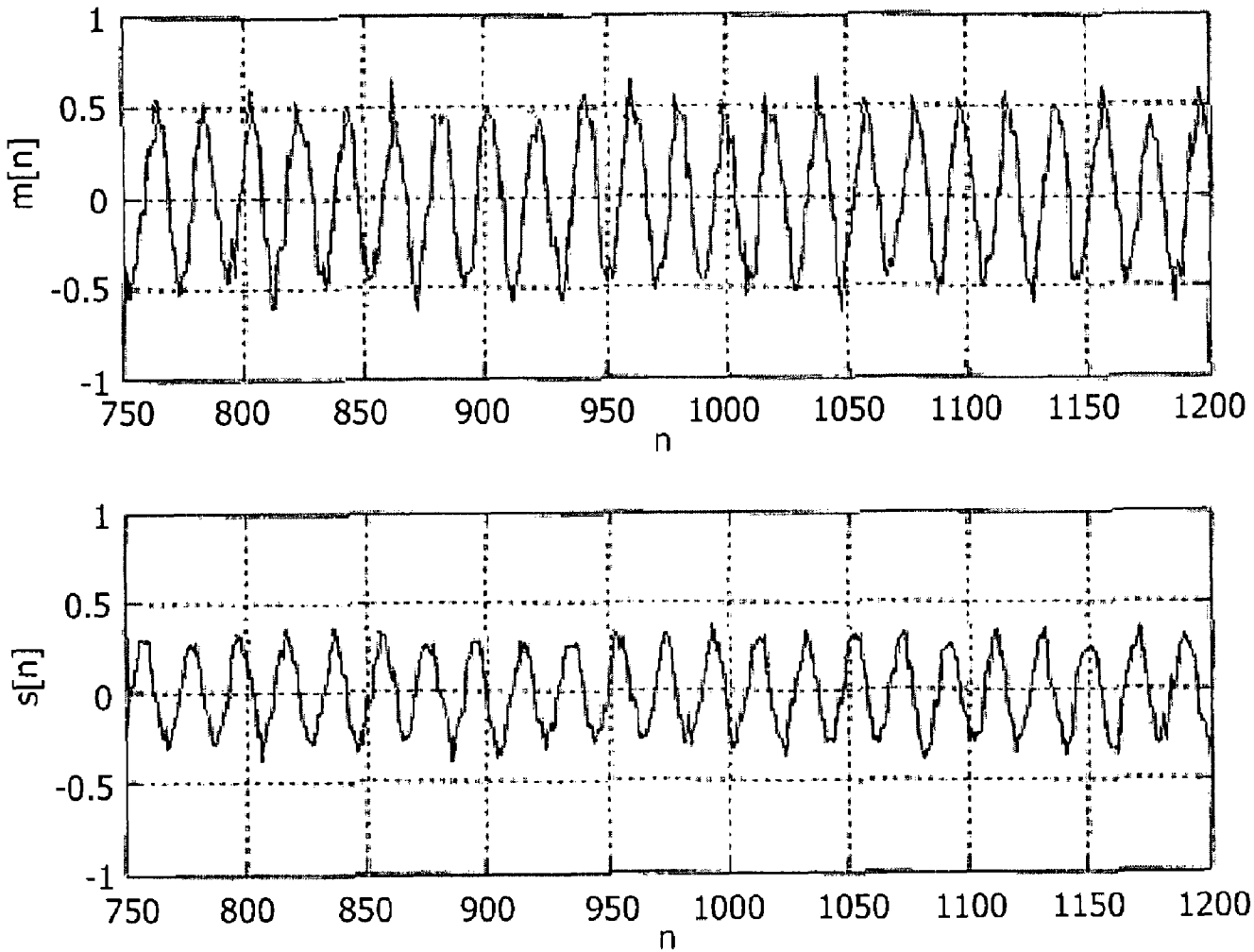
FIG. 3 is an illustration of application of a rotation transform pursuant to Equation 4 applied to the signals of FIG. 1 to generate corresponding dominant m[n] and residual s[n] signals.

By employing a rotation transform as described by Equation 4, it is possible for the example signals l[n], r[n] to reduce the residual energy in their corresponding residual signal s[n] and correspondingly enhance their dominant signal m[n] as illustrated in FIG. 3. Although the rotation approach of Equation 4 is capable of performing better than conventional M/S processing as presented in FIG. 2, it is found by the inventors to be unsatisfactory when the signals l[n], r[n] are subject to relative mutual phase and/or time shifts.

Figure 4:
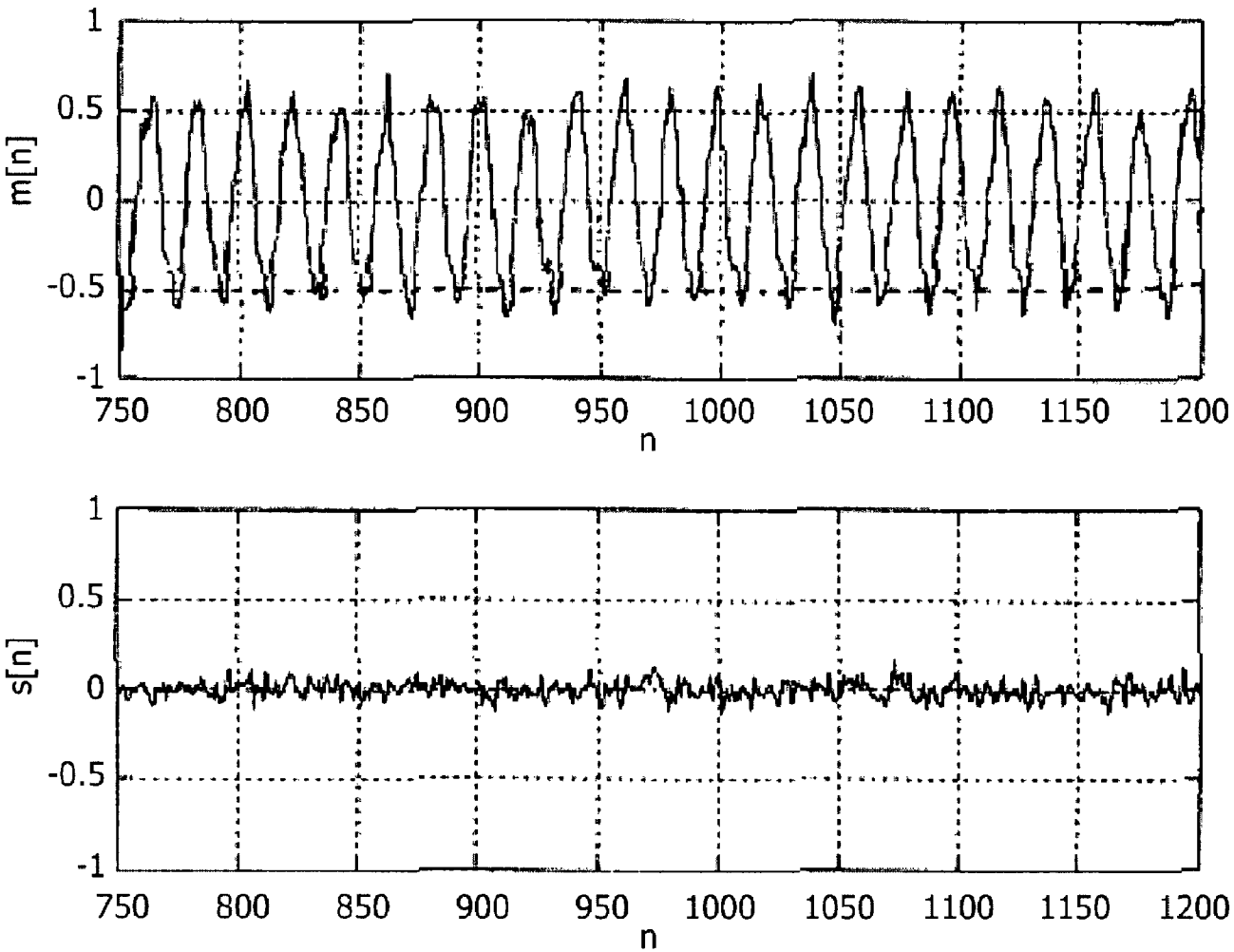
FIG. 4 is an illustration of application of a complex rotation transform according to the invention pursuant to Equations 5 to 15 to generate corresponding dominant m[n] and residual s[n] signals wherein the residual signal is of relatively small amplitude despite the signals of FIG. 1 having relative mutual phase and time delay.

When the sample signals l[n], r[n] of Equations 16 and 17 are subjected to transformation to the frequency domain, then subjected to a complex optimizing rotation pursuant to the Equations 5 to 15, it is feasible to reduce the energy of the residual signal s[n] to a comparatively small magnitude as illustrated in FIG. 4.

Embodiments of encoder hardware operable to implement signals processing as described by Equations 5 to 15 will next be described.

Figure 5:
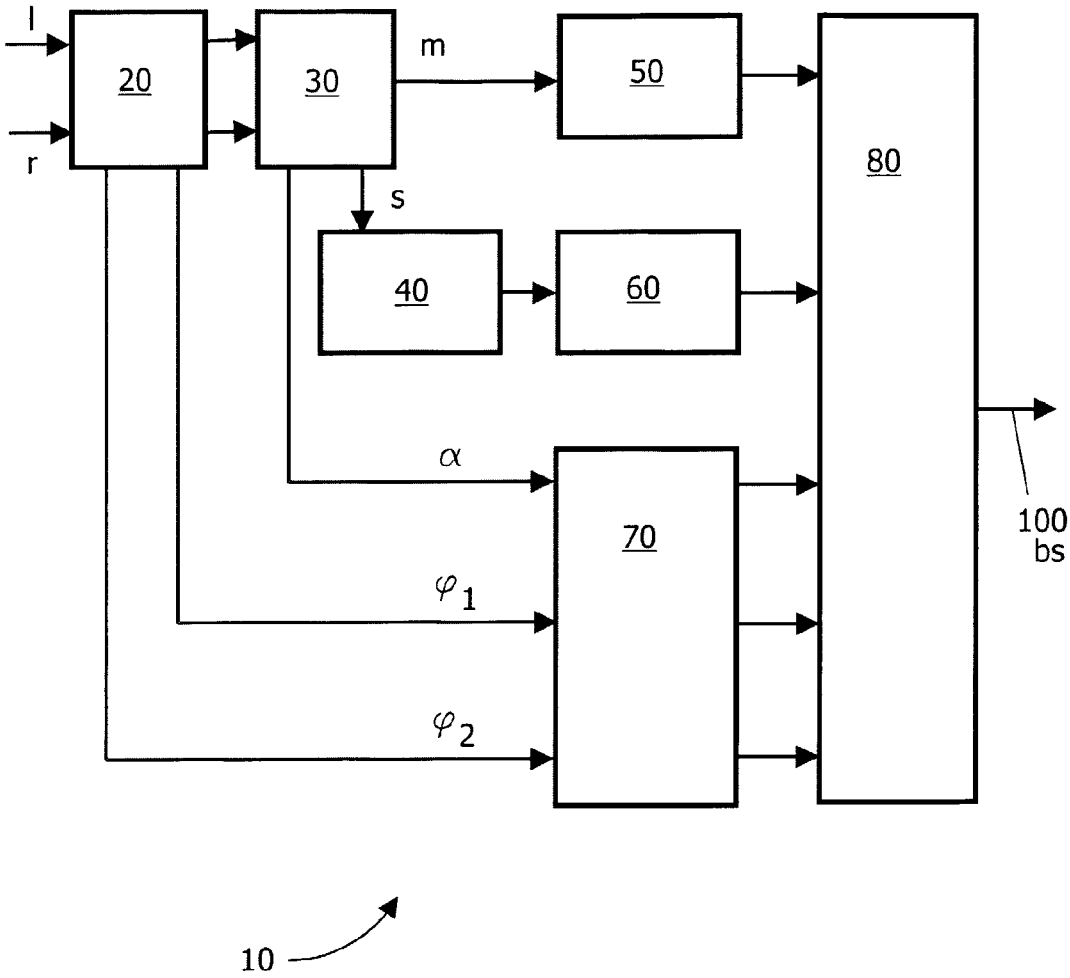
FIG. 5 is a schematic diagram of an encoder according to the invention.

In FIG. 5, there is shown an encoder according to the invention indicated generally by 10. The encoder 10 is operable to receive left (l) and right (r) complementary input signals and encode these signals to generate an encoded bit-stream (bs) 100. Moreover, the encoder 10 includes a phase rotation unit 20, a signal rotation unit 30, a time/frequency selector 40, a first coder 50, a second coder 60, a parameter quantizing processing unit (Q) 70 and a bit-stream multiplexer unit 80.

The input signals l, r are coupled to inputs of the phase rotation unit 20 whose corresponding outputs are connected to the signal rotation unit 30. Dominant and residual signals of the signal rotation unit 30 are denoted by m, s respectively. The dominant signal m is conveyed via the first coder 50 to the multiplexer unit 80. Moreover, the residual signal s is coupled via the time/frequency selector 40 to the second coder 60 and thereafter to the multiplexer unit 80. Angle parameter outputs $\phi_1$, $\phi_2$ from the phase rotation unit 20 are coupled via the processing unit 70 to the multiplexer unit 80. Additionally, an angle parameter output $\alpha$ is coupled from the signal rotation unit 30 via the processing unit 70 to the multiplexer unit 80. The multiplexer unit 80 comprises the aforementioned encoded bit stream output (bs) 100.

In operation, the phase rotation unit 20 applies processing to the signals l, r to compensate for relative phase differences therebetween and thereby generate the parameters $\phi_1$, $\phi_2$ wherein the parameter $\phi_2$ is representative of such relative phase difference, the parameters $\phi_1$, $\phi_2$ being passed to the processing unit 70 for quantizing and thereby including as corresponding parameter data in the encoded bit stream 100. The signals l, r compensated for relative phase difference pass to the signal rotation unit 30 which determines an optimized value for the angle $\alpha$ to concentrate a maximum amount of signal energy in the dominant signal m and a minimum amount of signal energy in the residual signal s. The dominant and residual signals m, s then pass via the coders 50, 60 to be converted to a suitable format for inclusion in the bit stream 100. The processing unit 70 receives the angle signals $\alpha$, $\phi_1$, $\phi_2$ and multiplexes them together with the output from the coders 50, 60 to generate the bit-stream output (bs) 100. Thus, the bit-stream (bs) 100 thereby comprises a stream of data including representations of the dominant and residual signals m, s together with angle parameter data $\alpha$, $\phi_1$, $\phi_2$ wherein the parameter $\phi_2$ is essential and the parameters $\phi_1$ are optional but nevertheless beneficial to include.

The coders 50, 60 are preferably implemented as two mono audio encoders, or alternatively as one dual mono encoder. Optionally, certain parts of the residual signal s, for example identified when represented in a time-frequency plane, not perceptibly contributing to the bit stream 100 can be discarded in the time/frequency selector 40, thereby providing scalable data compression as elucidated in more detail below.

The encoder 10 is optionally capable of being used for processing the input signals (l, r) over a part of a full frequency range encompassing the input signals. Those parts of the input signals (l, r) not encoded by the encoder 10 are then in parallel encoded using other methods, for example using conventional M/S encoding as described in the foregoing. If required individual encoding of left (l) and right (r) input signals can be implemented if required.

The encoder 10 is susceptible to being implemented in hardware, for example as an application specific integrated circuit or group of such circuits. Alternatively, the encoder 10 can be implemented in software executing on computing hardware, for example on a proprietary software-driven signal processing integrated circuit or group of such circuits.

Figure 6:
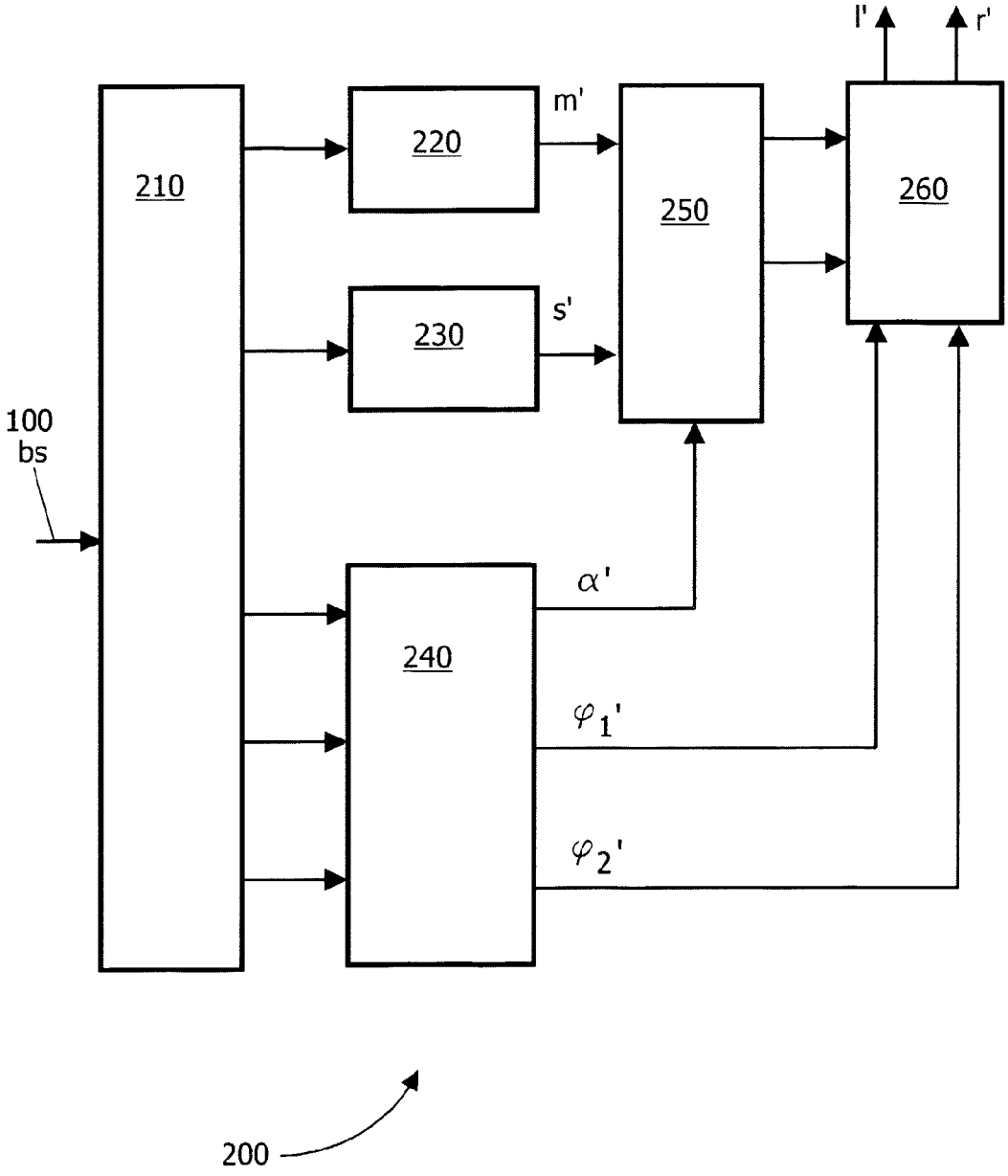
FIG. 6 is a schematic diagram of a decoder according to the invention, the encoder being compatible with the encoder of FIG. 5.

In FIG. 6, a decoder compatible with the encoder 10 is indicated generally by 200. The decoder 200 comprises a bit-stream demultiplexer 210, first and second decoders 220, 230, a processing unit 240 for de-quantizing parameters, a signal rotation decoder unit 250 and a phase rotation decoding unit 260 providing decoded outputs l', r' corresponding to the input signals l, r input to the encoder 10. The demultiplexer 210 is configured to receive the bit-steam (bs) 100 as generated by the encoder 10, for example conveyed from the encoder 10 to the decoder 200 by way of a data carrier, for example an optical disk data carrier such as a CD or DVD, and/or via a communication network, for example the Internet. Demultiplexed outputs of the demultiplexer 210 are coupled to inputs of the decoders 220, 230 and to the processing unit 240. The first and second decoders 220, 230 comprise dominant and residual decoded outputs m', s' respectively which are coupled to the rotation decoder unit 250. Moreover, the processing unit 240 includes a rotation angle output $\alpha'$ which is also coupled to the rotation decoder unit 250; the angle $\alpha'$ corresponds to a decoded version of the aforementioned angle $\alpha$ with regard to the encoder 10. Angle outputs $\phi_1'$, $\phi_2'$ correspond to decoded versions of the aforementioned angles $\phi_1$, $\phi_2$ with regard to the encoder 10; these angle outputs $\phi_1'$, $\phi_2'$ are conveyed, together with decoded dominant and residual signal outputs from the rotation decoder unit 250 to the phase rotation decoding unit 260 which includes decoded outputs l', r' as illustrated.

In operation, the decoder 200 performs an inverse of encoding steps executed within the encoder 10. Thus, in the decoder 200, the bit-stream 100 is demultiplexed in the demultiplexer 210 to isolate data corresponding to the dominant and residual signals which are reconstituted by the decoders 220, 230 to generate the decoded dominant and residual signals m', s'. These signals m', s' are then rotated according to the angle $\alpha'$ and then corrected for relative phase using the angles $\phi_1'$, $\phi_2'$ to regenerate the left and right signals l', r'. The angles $\phi_1'$, $\phi_2'$, $\alpha'$ are regenerated from parameters demultiplexed in the demultiplexer 210 and isolated in the processing unit 240.

In the encoder 10, and hence also in the decoder 200, it is preferable to transmit in the bit-stream 100 an IID value and a coherence value $\rho$ rather than the aforementioned angle $\alpha$. The IID value is arranged to represent an inter-channel difference, namely denoting frequency and time variant magnitude differences between the left and right signals l, r. The coherence value $\rho$ denotes frequency variant coherence, namely similarity, between the left and right signals l, r after phase synchronization. However, for example in the decoder 200, the angle $\alpha$is readily derivable from the IID and $\rho$ values by applying Equation 18 (Eq. 18):

$$\alpha = \frac{1}{2}\arctan\left(\frac{2\cdot 10^{\frac{IID}{20}}\cdot\rho}{10^{\frac{IID}{10}}-1}\right) \qquad \text{Eq. 18}$$

Figure 7:
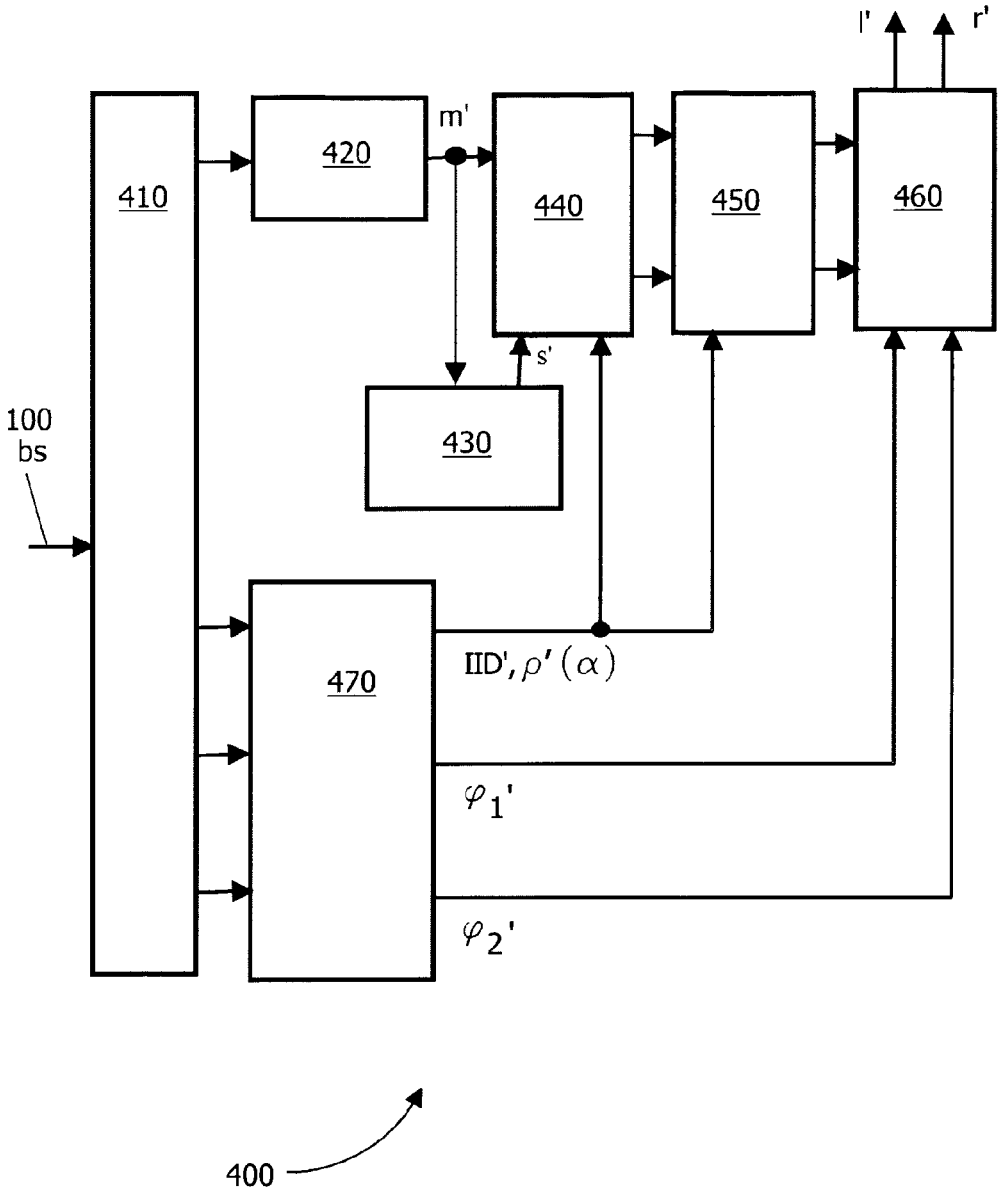
FIG. 7 is a schematic diagram of a parametric stereo decoder.

A parametric decoder is indicated generally by 400 in FIG. 7, this decoder 400 being complementary to the encoders according to the present invention. The decoder 400 comprises a bit-stream demultiplexer 410, a decoder 420, a decorrelation unit 430, a scaling unit 440, a signal rotation unit 450, a phase rotation unit 460 and a de-quantizing unit 470. The demuliplexer 410 comprises an input for receiving the bit-stream signal (bs) 100 and four corresponding outputs for signal m, s data, angle parameter data, IID data and coherence data $\rho$, these outputs are connected to the decoder 420 and to the de-quantizer unit 470 as shown. An output from the decoder 420 is coupled via the de-correlation unit 430 for regenerating a representation of the residual signal s' for input to the scaling function 440. Moreover, a regenerated representation of the dominant signal m' is conveyed from the decoder unit 420 to the scaling unit 440. The scaling unit 440 is also provided with IID' and coherence data p' from the de-quantizing unit 470. Outputs from the scaling unit 440 are coupled to the signal rotation unit 450 to generate intermediate output signals. These intermediate output signals are then corrected in the phase rotation unit 460 using the angles $\phi_1'$, $\phi_2'$ decoded in the de-quantizing unit 470 to regenerate representations of the left and right signals l', r'.

The decoder 400 is distinguished from the decoder 200 of FIG. 6 in that the decoder 400 includes the decorrelation unit 430 for estimating the residual signal s' based on the dominant signal m' by way of decorrelation processes executed within the de-correlation unit 430. Moreover, the amount of coherence between the left and right output signals l', r' is determined by way of a scaling operation. The scaling operation is executed within the scaling unit 440 and is concerned with a ratio between the dominant signal m' and the residual signal s'.

Figure 8:
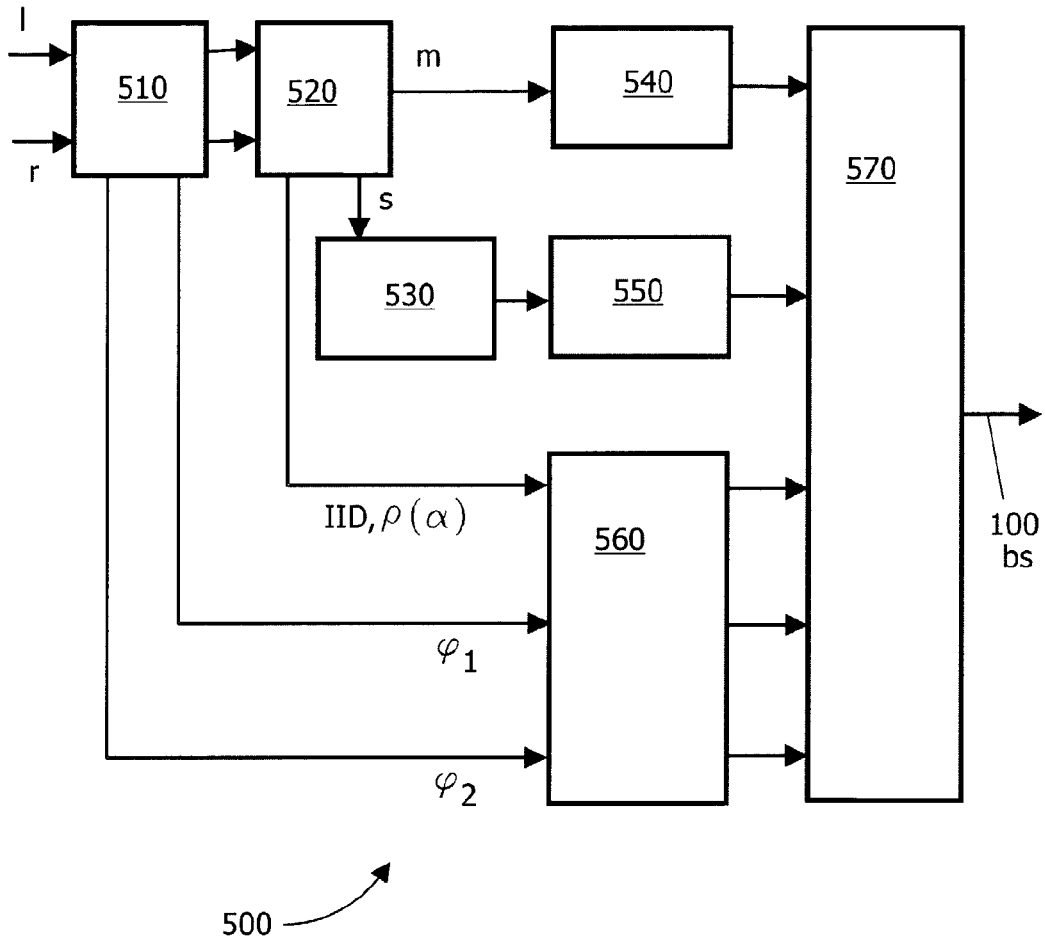
FIG. 8 is a schematic diagram of an enhanced parametric stereo encoder according to the invention.

Referring next to FIG. 8, there is illustrated an enhanced encoder indicated generally by 500. The encoder 500 comprises a phase rotation unit 510 for receiving left and right input signals l, r respectively, a signal rotation unit 520, a time/frequency selector 530, first and second coders 540, 550 respectively, a quantizing unit 560 and a multiplexer 570 including the bit-stream output (bs) 100. Angle outputs $\phi_1$, $\phi_2$ from the phase rotation unit 510 are coupled from the phase rotation unit 510 to the quantizing unit 560. Moreover, phase-corrected outputs from the phase rotation unit 510 are connected via the signal rotation unit 520 and the time/frequency selector 530 to generate dominant and residual signals m, s respectively, as well as IID and coherence ρ data/parameters. The IID and coherence ρ data/parameters are coupled to the quantizer unit 560 whereas the dominant and residual signals m, s are passed via the first and second coders 540, 550 to generate corresponding data for the multiplexer 570. The multiplexer 570 is also arranged to receive parameter data describing the angles $\phi_1$, $\phi_2$, the coherence ρ and the IID. The multiplexer 570 is operable to multiplex data from the coders 540, 550 and the quantizing unit 560 to generate the bit-stream (bs) 100.

In the encoder 500, the residual signal s is encoded directly into the bit-stream 100. Optionally, the time/frequency selector unit 530 is operable to determine which parts of the time/frequency plane of the residual signal s are encoded into the bit-stream (bs) 100, the unit 530 thereby determining a degree to which residual information is included the bit-stream 100 and hence affecting a compromise between compression attainable in the encoder 500 and degree of information included within the bit-stream 100.

Figure 9:
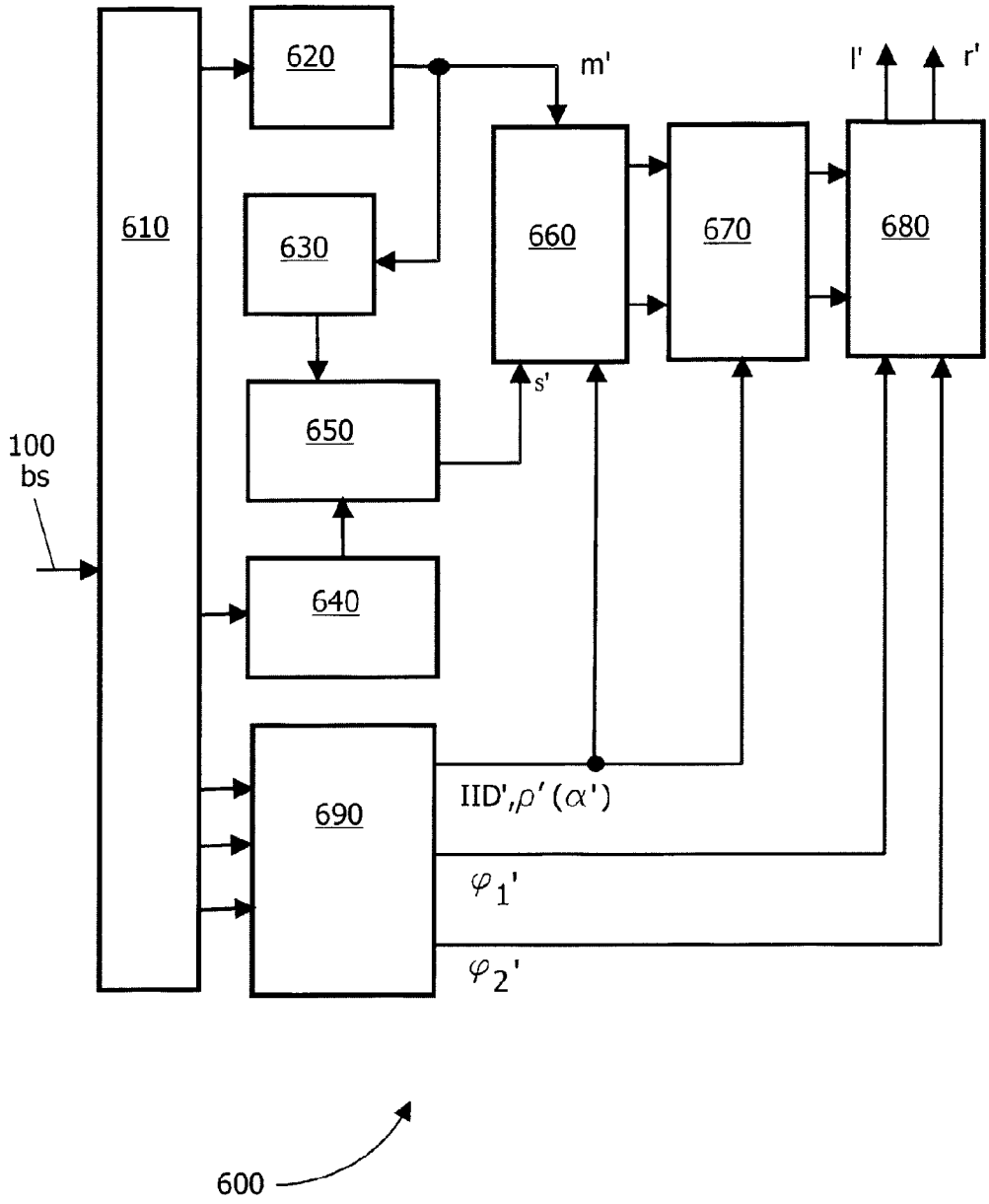
FIG. 9 is a schematic diagram of an enhanced parametric stereo decoder according to the invention, the decoder being compatible with the encoder of FIG. 9.

In FIG. 9, an enhanced parametric decoder is indicated generally by 600, the decoder 600 being complementary to the encoder 500 illustrated in FIG. 8. The decoder 600 comprises a demultiplexer unit 610, first and second decoders 620, 640 respectively, a de-correlation unit 630, a combiner unit 650, a scaling unit 660, a signal rotation unit 670, a phase rotation unit 680 and the de-quantizing unit 690. The demultiplexer unit 610 is coupled to receive the encoded bit-stream (bs) 100 and provide corresponding demultiplexed outputs to the first and second decoders 620, 640 and also to the demultiplexer unit 690. The decoders 620, 640 in conjunction with the de-correlation unit 630 and the combiner unit 650 are operable to regenerate representations of the dominant and residual signals m', s' respectively. These representations are subjected to scaling processes in the scaling unit 660 followed by rotations in the signal rotation unit 670 to generate intermediate signals which are then phase rotated in the rotation unit 680 in response to angle parameters generated by the de-quantizing unit 690 to regenerate representations of the left and right signals l', r'.

In the decoder 600, the bit-stream 100 is de-multiplexed into separate streams for the dominant signal m', for the residual signal s' and for stereo parameters. The dominant and residual signals m', s' are then decoded by the decoders 620, 640 respectively. Those spectral/temporal parts of the residual signal s' which have been encoded into the bit-stream 100 are communicated in the bit-stream 100 either implicitly, namely by detecting "empty" areas in the time-frequency plane, or explicitly, namely by means of representative signalling parameters decoded from the bit stream 100. The de-correlation unit 630 and the combiner unit 650 are operable to fill empty time-frequency areas in the decoded residual signal s' effectively with a synthetic residual signal. This synthetic signal is generated by using the decoded dominant signal m' and output from the de-correlation unit 650. For all other time-frequency areas, the residual signal s is applied to construct the decoded residual signal s'; for these areas, no scaling is applied in the scaling unit 660. Optionally, for these areas, it is beneficial to transmit the aforementioned angle α in the encoder 500 instead of IID and coherence ρ data as data rate required to convey the single angle parameter α is less than required to convey equivalent IID and coherence ρ parameter data. However, transmission of the angle α parameter in the bit stream 100 instead of the IID and ρ parameter data renders the encoder 500 and decoder 600 non-backwards compatible with regular conventional Parametric Stereo (PS) systems which utilize such IID and coherence ρ data.

The selector units 40, 530 of the encoders 10, 500 respectively are preferably arranged to employ a perceptual model when selecting which time-frequency areas of the residual signal s need to be encoded into the bit-stream 100. By coding various time-frequency aspects of the residual signal s in the encoders 10, 500, it is possible to thereby achieve bit-rate scalable encoders and decoders. When layers in the bit-stream 100 are mutually dependent, coded data corresponding to perceptually most relevant time-frequency aspects are included in a base layer included in the layers, with perceptually less important data moved to refinement or enhancement layers included in the layers; "enhancement layer" is also referred to as being "refinement layer". In such an arrangement, the base layer preferably comprises a bit stream corresponding to the dominant signal m, a first enhancement layer comprises a bit stream corresponding to stereo parameters such as aforementioned angles α, $\phi_1$, $\phi_2$, and a second enhancement layer comprises a bit stream corresponding to the residual signal s.

Such an arrangement of layers in the bit-stream data 100 allows for the second enhancement layer conveying the residual signal s to be optionally lost or discarded; moreover, the decoder 600 illustrated in FIG. 10 is capable of combining decoded remaining layers with a synthetic residual signal as described in the foregoing to regenerate a perceptually meaningful residual signal for user appreciation. Furthermore, if the decoder 600 is optionally not provided with the second decoder 640, for example due to cost and/or complexity restrictions, it is still possible to decode the residual signal s albeit at reduced quality.

Further bit rate reductions in the bit stream (bs) 100 in the foregoing are possible by discarding encoded angle parameters $\phi_1$, $\phi_2$ therein. In such a situation, the phase rotation unit 680 in the decoder 600 reconstructs the regenerated output signals l', r' using a default rotation angles of fixed value, for example zero value; such further bit rate reduction exploits a characteristic that the human auditory system is relative phase-insensitive at higher audio frequencies. As an example, the parameters $\phi_2$ are transmitted in the bit stream (bs) 100 and the parameters $\phi_1$ are discarded therefrom for achieving bit rate reduction.

Encoders and complementary decoders according to the invention described in the foregoing are potentially useable in a broad range of electronic apparatus and systems, for example in at least one of: Internet radio, Internet streaming, Electronic Music Distribution (EMD), solid state audio players and recorders as well as television and audio products in general.

Although a method of encoding the input signals (l, r) to generate the bit-stream 100 is described in the foregoing, and complementary methods of decoding the bit-stream 100 elucidated, it will be appreciated that the invention is susceptible to being adapted to encode more than two input signals. For example, the invention is capable of being adapted for providing data encoding and corresponding decoding for multichannel audio, for example 5-channel domestic cinema systems.

In the accompanying claims, numerals and other symbols included within brackets are included to assist understanding of the claims and are not intended to limit the scope of the claims in any way.

It will be appreciated that embodiments of the invention described in the foregoing are susceptible to being modified without departing from the scope of the invention as defined by the accompanying claims.

Expressions such as "comprise", "include", "incorporate", "contain", "is" and "have" are to be construed in a non-exclusive manner when interpreting the description and its associated claims, namely construed to allow for other items or components which are not explicitly defined also to be present. Reference to the singular is also to be construed to be a reference to the plural and vice versa.

The invention claimed is:

1. A non-transitory computer-readable storage medium having encoded data recorded thereon, said encoded data comprising a multiplex of quantizing first parameters, quantized second parameters, and quantized data corresponding to at least a part of a dominant signal (m) and a residual signal (s), wherein the dominant signal (m) has a magnitude or energy greater than the residual signal (s), said dominant signal (m) and said residual signal (s) being derivable by rotating intermediate signals according to the second parameters, said intermediate signals being generated by processing a plurality of input signals to compensate for at least one of relative phase differences and temporal delays therebetween as described by the first parameters.

2. An encoding and decoding arrangement for encoding at least a first and a second wideband digital audio signal component into a composite data signal and for decoding the composite data signal into a replica of said at least first and second digital audio signal components, the encoding arrangement comprising:

an input for receiving the at least first and second wideband digital audio signal components, respectively;

a time-to-frequency transformer for converting each of the wideband first and second digital audio signal components into a plurality of narrow band sub-signals, a sub-signal for a narrow band for a wideband digital audio signal component being representative of the wideband audio signal component in said narrow band;

a signal rotator for converting, in a narrow band, the sub-signals of said first and second digital audio signal components in said narrow band into a composite sub-signal for said narrow band, the signal rotation unit further being adapted to optionally convert, in a narrow band, the sub-signals of said first and second digital audio signal components into an error sub-signal;

a signal combiner for combining the composite sub-signals and any error sub-signals into a composite data signal; and an output for supplying the composite data signal, and the decoding arrangement comprising:

an input for receiving the composite data signal;

a demultiplexer for retrieving the composite sub-signals and any error sub-signals from the composite data signal;

a decorrelator for decorrelating the composite sub-signals into decorrelated sub-signals;

a further signal combiner for combining, in a narrow band, the decorrelated sub-signal in said narrow band, and the error sub-signal in said narrow band, such that, upon the presence of an error sub-signal in the narrow band, the error signal is supplied as an output signal at an output of the further combination unit, and upon the absence of an error sub-signal in the narrow band, the decorrelated sub-signal in said narrow band is supplied as the output signal at the output of the further combination unit;

a further signal rotator for converting, in a narrow band, the composite sub-signals and the output signals into replicas of the sub-signals for the first and second digital audio signal components in said narrow band; and a frequency-to-time transformer for converting the replicas of the sub-signals of the first and second digital audio signal components into a replica of the first and the second digital audio signal component.

3. The encoding and decoding arrangement as claimed in claim 2, wherein the signal rotator is adapted for converting, in subsequent time intervals, in a narrow band, the sub-signals of said first and second digital audio signal components in said narrow band into a composite sub-signal for said narrow band in said subsequent time intervals, the signal rotator further being adapted to optionally convert, in a specific time interval, in said narrow band, the sub-signals of said first and second digital audio signal components into an error sub-signal, wherein the further signal combiner is adapted for combining, in a specific time interval and in a narrow band, the decorrelated sub-signal in said specific time interval and said narrow band, and the error sub-signal in said specific time interval and said narrow band, such that, upon the presence of an error sub-signal in a specific time interval and in a narrow band, the error sub-signal is supplied as an output signal at an output of the further signal combiner and upon the absence of an error sub-signal in said specific time interval and in said narrow band, the decorrelated sub-signal in said specific time interval and said narrow band is supplied as the output signal at the output of the further signal combiner, and wherein the further signal rotator is adapted for converting, in subsequent time intervals, in a narrow band, the composite sub-signals and the output signals into replicas of the sub-signals for the first and second digital audio signal components in said narrow band in each of said time intervals.

4. The encoding and decoding arrangement as claimed in claim 2, wherein the signal rotator further is adapted to generate a control signal indicating whether an error signal is available for a narrow band or not, the signal combination unit further being adapted to combine the control signal into said composite data signal, and wherein the demultiplexer further is adapted to retrieve the control signal from said composite data signal, the further signal rotator being adapted to supply the error sub-signal or the decorrelated sub-signal to its output in dependence of the control signal.

5. The encoding and decoding arrangement as claimed in claim 3, wherein the signal rotator further is adapted to generate the control signal such that the control signal indicates whether, in a time interval, the error signal is available for a narrow band or not, the signal combination unit further being adapted to combine the control signal into said composite data signal, and wherein the demultiplexer further is adapted to retrieve the control signal from said composite data signal, the further signal rotator being adapted to supply the error sub-signal or the decorrelated sub-signal to its output in dependence of the control signal.

6. A decoding arrangement for use in the arrangement as claimed in claim 2, the decoding arrangement comprising an input for receiving the composite data signal;

a demultiplexer for retrieving the composite sub-signals and any error sub-signals from the composite data signal;

a decorrelator for decorrelating the composite sub-signals into decorrelated sub-signals;

a further signal combiner for combining, in a narrow band, the decorrelated sub-signal in said narrow band, and the error sub-signal in said narrow band, such that, upon the presence of an error sub-signal in the narrow band, the error sub-signal is supplied as an output signal at an output of the further signal combiner, and upon the absence of an error sub-signal in the narrow band, the decorrelated sub-signal in said narrow band is supplied as the output signal at the output of the further signal combiner;

a further signal rotator for converting, in a narrow band, the composite sub-signals and the output signals into replicas of the sub-signals for the first and second digital audio signal components in said narrow band; and a frequency-to-time transformer for converting the replicas of the sub-signals of the first and second digital audio signal components into a replica of the first and the second digital audio signal component.

7. A decoding arrangement for use in the arrangement as claimed in claim 3 or 5, the decoding arrangement comprising:

an input for receiving the composite data signal;

a demultiplexer for retrieving the composite sub-signals and any error sub-signals from the composite data signal;

a united correlator for decorrelating the composite sub-signals into decorrelated sub-signals, a further signal combiner for combining, in a specific time interval and in a narrow band, the decorrelated sub-signal in said specific time interval and said narrow band, and the error sub-signal in said specific time interval and said narrow band, such that, upon the presence of an error sub-signal in a specific time interval and in a narrow band, the error sub-signal is supplied as an output signal at an output of the further signal combiner, and upon the absence of an error sub-signal in said specific time interval and in said narrow band, the decorrelated sub-signal in said specific time interval and said narrow band is supplied as the output signal at the output of the further signal combiner;

a further signal rotator for converting, in subsequent time intervals, in a narrow band, the composite sub-signals and the output signals into replicas of the sub-signals for the first and second digital audio signal components in said narrow band in each of said time intervals; and a frequency-to-time transformer for converting the replicas of the sub-signals of the first and second digital audio signal components into a replica of the first and the second digital audio signal component.

8. A decoding arrangement for use in the arrangement as claimed in claim 4, the decoding arrangement comprising an input for receiving the composite data signal;

a demultiplexer for retrieving the composite sub-signals and any error sub-signals from the composite data signal;

a decorrelator for decorrelating the composite sub-signals into decorrelated sub-signals;

a further signal combiner for combining, in a narrow band, the decorrelated sub-signal in said narrow band, and the error sub-signal in said narrow band, such that, upon the presence of an error sub-signal in the narrow band, the error sub-signal is supplied as an output signal at an output of the further signal combiner, and upon the absence of an error sub-signal in the narrow band, the decorrelated sub-signal in said narrow band is supplied as the output signal at the output of the further signal combiner;

a further signal rotator for converting, in a narrow band, the composite sub-signals and the output signals into replicas of the sub-signals for the first and second digital audio signal components in said narrow band; and a frequency-to-time transformer for converting the replicas of the sub-signals of the first and second digital audio signal components into a replica of the first and the second digital audio signal component.

9. The decoding arrangement as claimed in claim 8, wherein the demultiplexer further is adapted to retrieve the control signal from said composite data signal, the further signal rotator being adapted to supply the error sub-signal or the decorrelated sub-signal to its output in dependence of the control signal.

* * * * *